United States Patent [19]

Hinchcliffe et al.

[11] 4,303,366

[45] Dec. 1, 1981

[54] METHOD AND APPARATUS FOR UNLOADING ROD-LIKE ARTICLES FROM CONTAINERS

[75] Inventors: Dennis Hinchcliffe; George C. Leigh, both of London, England

[73] Assignee: Molins Limited, London, England

[21] Appl. No.: 855,775

[22] Filed: Nov. 29, 1977

[30] Foreign Application Priority Data

Dec. 3, 1976 [GB] United Kingdom ..... 50439/76

[51] Int. Cl.[3] ..... B65G 65/23

[52] U.S. Cl. ..... 414/419; 198/347; 414/421

[58] Field of Search ..... 214/302, 307, 312, 314; 198/347, 547, 557, 616; 414/414, 404, 405, 419, 421; 53/475

[56] References Cited

U.S. PATENT DOCUMENTS

| | | | |
|---|---|---|---|
| 2,753,062 | 7/1956 | Loudon | 414/414 |
| 3,596,787 | 8/1971 | Rowlands et al. | 214/307 X |
| 3,598,268 | 8/1971 | Wallace | 214/314 X |
| 3,600,873 | 8/1971 | Pirat | 53/475 |
| 3,655,080 | 4/1972 | Gianese | 214/307 X |
| 3,703,242 | 11/1972 | Marradi | 214/314 X |
| 4,042,137 | 8/1977 | Hughes et al. | 414/421 X |
| 4,069,930 | 1/1978 | Atwell | 214/314 X |
| 4,120,391 | 10/1978 | Molins et al. | 198/347 |

*Primary Examiner*—Trygve M. Blix
*Assistant Examiner*—Edmond G. Rishell, Jr.
*Attorney, Agent, or Firm*—Craig and Antonelli

[57] ABSTRACT

Trays containing parallel rod-like articles are unloaded by rotation until the trays are at least partially inverted, the rotation being about an axis parallel to the articles. In one arrangement a pair of tray carriers is rotatable to successively invert a full tray over delivery conveyors and to return an empty tray. One of the conveyors is also rotatable about the same axis. A removable slat retains the articles in the full tray until it is completely inverted. In another arrangement a full tray is received in a bracket in which it is moved to a tilted position for unloading. A pivoted closure member is provided for the open top of the tray and this also serves as a barrier for the unloading articles.

13 Claims, 6 Drawing Figures

23 ROTATABLE FRAME
116
ARM 118
114
30
PLATE
26
120a LOCATING ELEMENT
22
14
24
20b LOCATING ELEMENT
14
18 ARM
16
10
12
40
14

METHOD AND APPARATUS FOR UNLOADING ROD-LIKE ARTICLES FROM CONTAINERS

BACKGROUND OF THE INVENTION

This invention relates to a method and apparatus for unloading rod-like articles from containers. In particular the invention is concerned with a method and apparatus for unloading cigarettes or filter rods from trays, for example in order to feed cigarettes into a cigarette packing machine or to supply filter rods to the magazine of a pneumatic distributing device. For convenience, reference will be made generally to "cigarettes" but it should be understood that this term is intended to include similar rod-like articles such as cigarette filter rods and rod-like smokable articles other than cigarettes.

In the cigarette industry it has become common to transport and/or temporarily store cigarettes in trays, which usually have a depth about the same as the length of the cigarettes and which store the cigarettes parallel to the depth dimension. A conventional tray is open on its front face and on its upper side, as referred to the normal disposition of a tray in handling apparatus, i.e. with the cigarettes substantially horizontal. In typical tray unloading apparatus, for example for delivering cigarettes into the hopper of a cigarette packing machine, trays are successively inverted over the hopper to allow the cigarettes to fall from the trays into the hopper. Alternatively, instead of being inverted directly over a packing machine hopper, trays may be inverted over conveyor means for moving the unloaded cigarettes away for further processing, e.g. packing. Trays are conventionally inverted by rotation about an axis lying at right angles to the lengths of the cigarettes, i.e. the axis is parallel to the long sides of a tray. Such apparatus is disclosed, for example, in British Patent Specification No. 1,191,342.

BRIEF DESCRIPTION OF THE INVENTION

The present invention contemplates unloading trays by rotation about an axis substantially parallel to the cigarettes in the tray, i.e. substantially parallel to the short sides of a conventional tray. Accordingly, one aspect of the present invention provides apparatus for unloading trays of rod-like articles, comprising a tray carrier for receiving a tray, the tray being capable of holding one or more stacks of rod-like articles arranged with their lengths parallel, the tray carrier being rotatable, about an axis parallel to the lengths of the rod-like articles in a tray supported by the carrier, between a first position at which the tray carrier can receive a tray in a substantially upright position and a second position at which a tray held by the tray carrier is at least partially inverted; and delivery means for moving away rod-like articles unloaded from a tray when the carrier is in said second position. Preferably the apparatus includes removable or releasable closure means for the open upper end of a tray, the closure means serving to retain rod-like articles in the tray as the carrier is rotated until said second position is reached. The delivery means preferably includes one or more endless band conveyors for moving rod-like articles away from an unloading tray in the form of a stack. The delivery means may include a stack elevator.

In one arrangement a tray in the carrier may be inverted over a pair of delivery conveyors which are driven towards each other to deliver the unloading rod-like articles between the confronting ends of the conveyors and down on to a further stack delivery conveyor. One of the pair of delivery conveyors may conveniently be arranged to be rotatable with said carrier about said axis. The carrier may conveniently be rotatable through 180° between the first and second positions. The carrier itself may be one of a pair of carriers mounted in 180° rotational symmetry relative to said axis so that an empty tray may be moved away from the unloading position as the next full tray is moving towards this position (i.e. from the first to the second position of the tray carrier). In this case it may be desirable to arrange for each carrier to be retractable in a direction parallel to the axis to avoid possible interference between empty and full trays. Conveyor systems may be provided for supplying full trays to the or each tray carrier and for removing empty trays.

In a further possible arrangement the tray carrier may be rotatable through less than 180° but more than 90°, and typically through about 135°, so that in the second position a tray is in a tilted attitude from which it is still able to unload its contents. The tray carrier may be provided with a pivoted closure means which is releasable at the second position to allow the rod-like articles to unload and which also forms a barrier for the unloading articles. For this latter purpose the inner side of the closure means, which comes into contact with the rod-like articles, may be provided with a resilient surface, such as a strip of foamed rubber or polyurethane material.

BRIEF DESCRIPTION OF THE DRAWINGS

The invention will now be further described, by way of example only, with reference to the accompanying diagrammatic drawings in which.

DETAILED DESCRIPTION OF THE PREFERRED EMBODIMENTS

Figure 1:
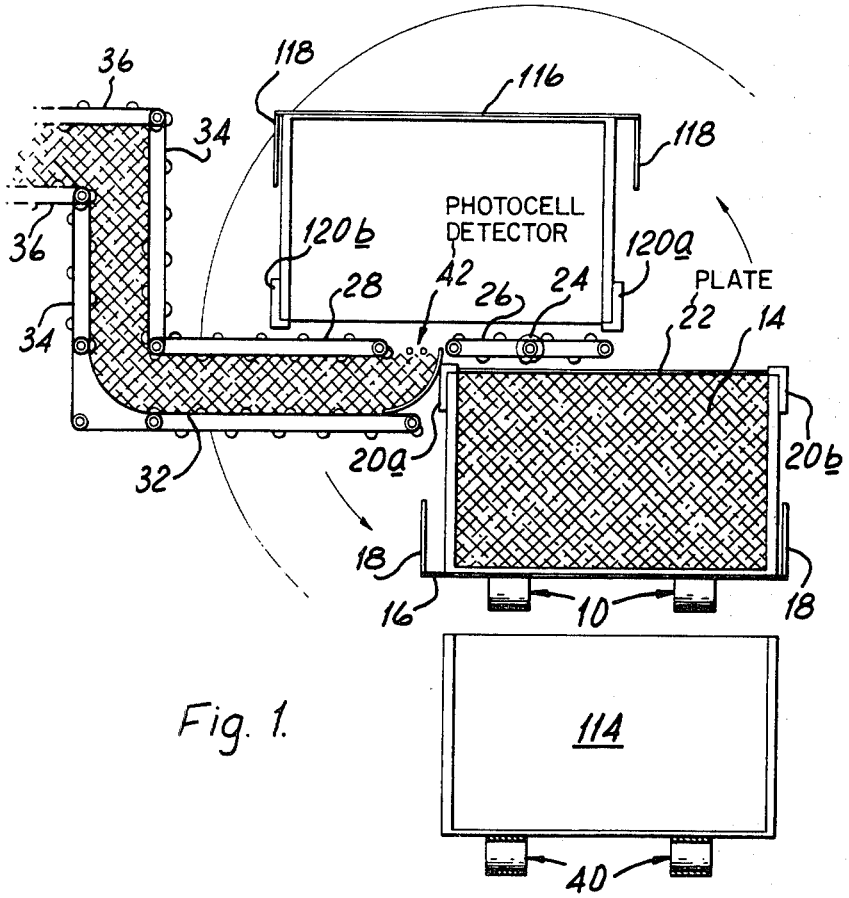
FIG. 1 is an elevation of a tray unloader.
Figure 2:
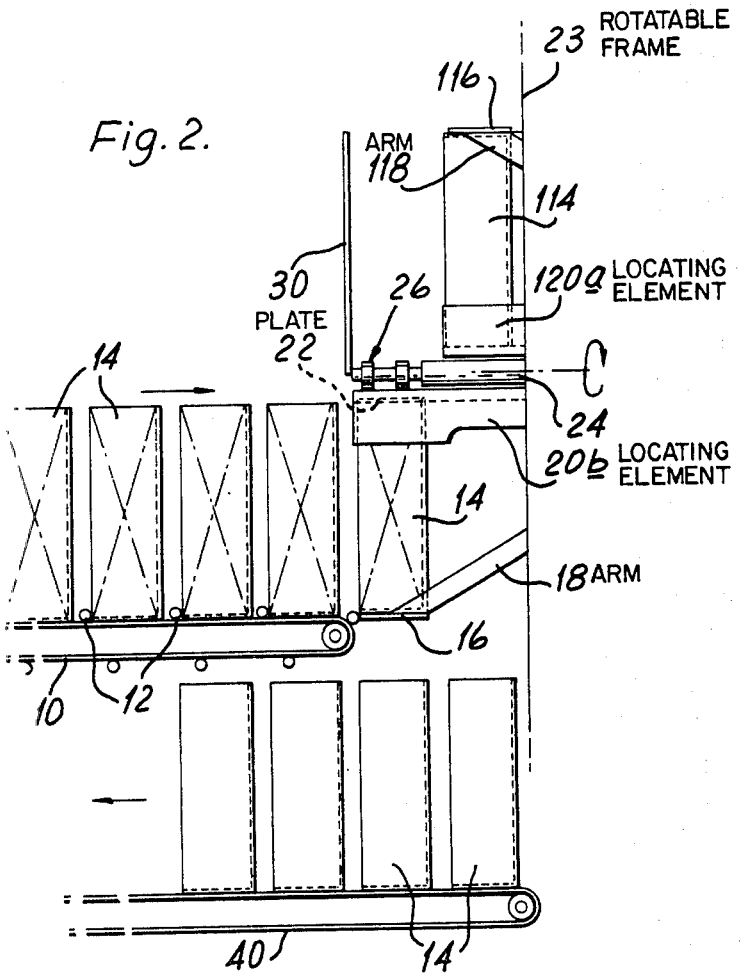
FIG. 2 is a side view of the tray unloader of FIG. 1.

Referring first to FIGS. 1 and 2, a pair of spaced conveyor bands 10 provided with interconnecting pitched bars 12 is arranged to move a succession of trays 14 containing cigarettes to the right as viewed in FIG. 2. Successive leading trays 14 are delivered on to a platform 16 supported by a pair of angled side arms 18. The arms 18 are pivoted and movable, e.g. by connection to a pneumatic or hydraulic piston, so that after receiving a tray 14 the platform 16 may be lifted slightly to clamp the upper edges of the tray against locating elements **20*a* and 20*b*. The element 20*b* may be similarly movable or spring-biased towards the element 20*a* so that the tray is positively located horizontally as well as vertically. A safety plate 22 which is supported between the elements 20*a* and 20*b* covers the open top of the tray 14 on the platform 16**.

Figure 3:
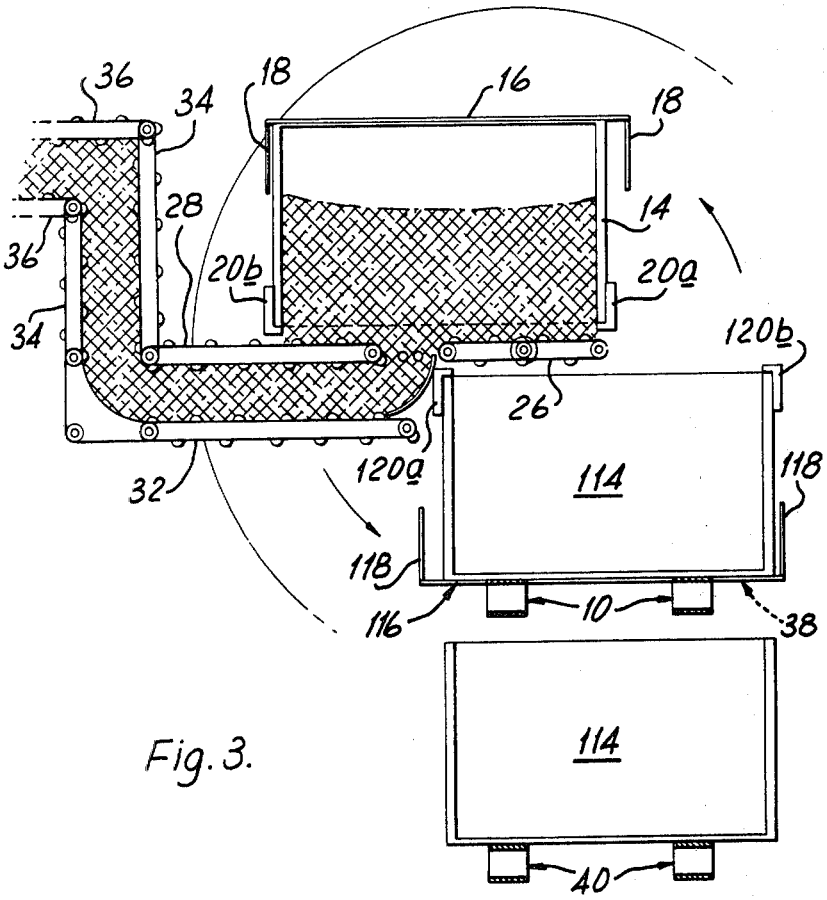
FIG. 3 is a view, corresponding to FIG. 1, of the tray unloader in a different stage of operation.
Figure 4:
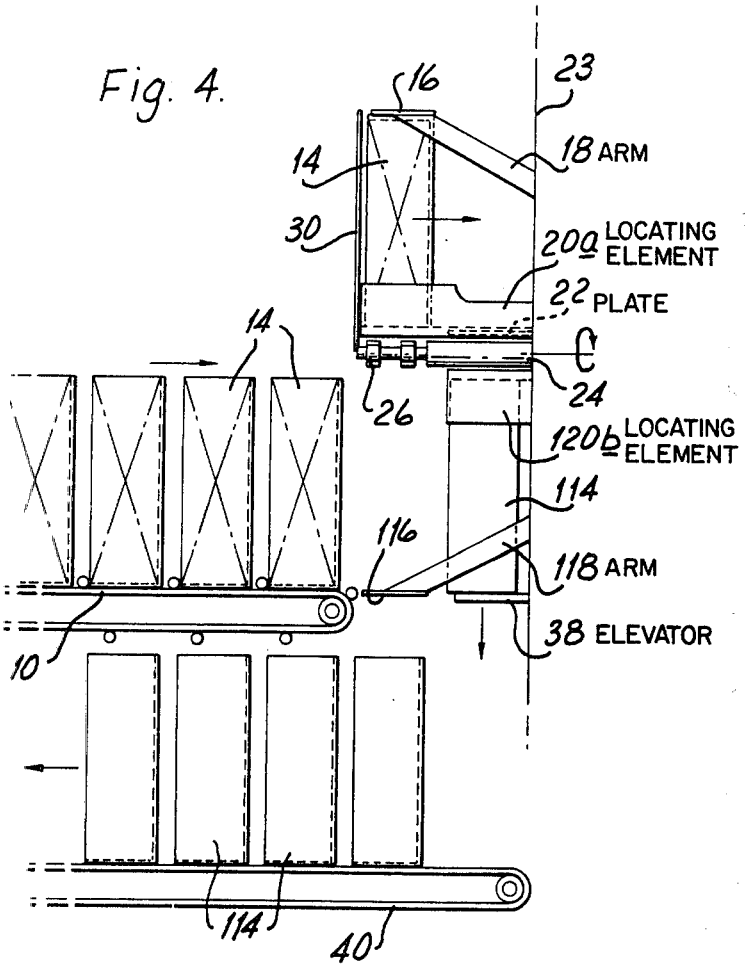
FIG. 4 is a side view of the tray unloader of FIG. 3.

The arms 18 and elements **20*a*, 20*b* are attached to a frame, the edge of which is indicated by the line 23 in FIG. 2, which is rotatable about the axis of a fixed spindle 24. Thus the tray 14, while held by the platform 16 and elements 20*a*, 20*b* and with the safety plate 22 covering the open top of the tray, may be rotated through 180° about an axis parallel to the cigarettes in the tray, from the position shown in FIGS. 1 and 2 to that shown in FIGS. 3 and 4. In this latter position the tray 14 is supported over first and second ribbed delivery bands 26, 28 with its open front face adjacent a fixed vertical plate 30. On withdrawal of the safety plate 22, e.g. by pneumatic piston means, to a retracted position, as indicated in FIG. 4, cigarettes are unloaded from the tray 14 with the aid of bands 26 and 28 which are driven towards each other so that the cigarettes are fed towards and between the confronting ends of the bands and down on to a stack delivery conveyor 32. The lower run of the band 28 forms a top band for the stack, which is subsequently conveyed by means of elevating bands 34 and further delivery conveyors 36** towards processing apparatus, e.g. the hopper of a cigarette packing machine. A variable capacity reservoir (not shown) may be arranged between the tray unloader and the further processing apparatus, to accommodate variations in stack flow.

It can be seen from the drawings that, in addition to the platform 16, arms 18 and locating elements 20*a*, 20*b*, there is a similar set of corresponding members 116, 118, 120*a* and 120*b*, respectively, located on the same frame and in 180° rotational symmetry relative to spindle 24. After the tray 14, in the position shown in FIG. 4, has been unloaded the arms 18 and locating elements 20*a*, 20*b* are retracted to the positions of the arms 118 and elements 120*a*, 120*b* shown in FIG. 2. At the same time a further full tray 14 is received on the other platform (16 in FIG. 2). On rotation of the frame from the position shown in FIG. 2 to supply another full tray 14 for unloading, the now empty tray 114 is rotated to the position shown in FIG. 4. Here the platform 116 and arms 118 are advanced to their forward position while the locating elements 120*a*, 120*b* restrain the tray 114 so that it is deposited on an elevator 38. The elevator 38 subsequently lowers the tray 114 on to a pair of band conveyors 40 which carry empty trays away from the apparatus for eventual reloading. The locating elements 120*a*, 120*b* (and the associated safety plate) are advanced to their forward position to receive another full tray 14 from the conveyor 10 after the tray 114 has been lowered on the elevator 38.

Movement of the arms 18 and elements 20 and arms 118 and elements 120 parallel to the axis of spindle 24 may be obtained by mounting the arms and elements on slides which are movable axially in the frame (23) by piston means. The elevator 38 could comprise a platform supported by a pair of chains running within the frame (23).

It should be noted that the frame (23) supporting platforms 16, 116 and locating elements 20, 120 etc. also supports the band conveyor 26, so that this conveyor is also rotated about spindle 24 during a tray change. Furthermore it will be appreciated that various drive and control mechanisms are provided for effecting rotation of the frame and movement of the arms 18, 118, elements 20, 120 and elevator 28. The drive mechanism for rotating the frame may be actuated in response to a photocell detector 42 which senses when the level of cigarettes from an unloading tray falls below a predetermined level, i.e. it indicates when the tray is empty. The detector 42 can also be used to control the stack delivery conveyors 32, 34 etc.

The ribbed conveyor bands used in various parts of the apparatus may be substantially as described in British Patent Specification No. 1,453,191 or may have somewhat smaller ribs, corresponding in cross-section to approximately half a cigarette. The arrangement for feeding cigarettes away from an inverted tray may be modified in accordance with the arrangements disclosed in U.S. Pat. No. 3,985,252 or German Specification No. P 26 19 366. The shallow hopper region between the inverted tray and the conveyors 26, 28 could be provided with flow control means in the form of a series or grid of rods arranged with their axes parallel to the cigarettes, substantially as disclosed in our British Pat. No. 1,585,066.

Figure 5:
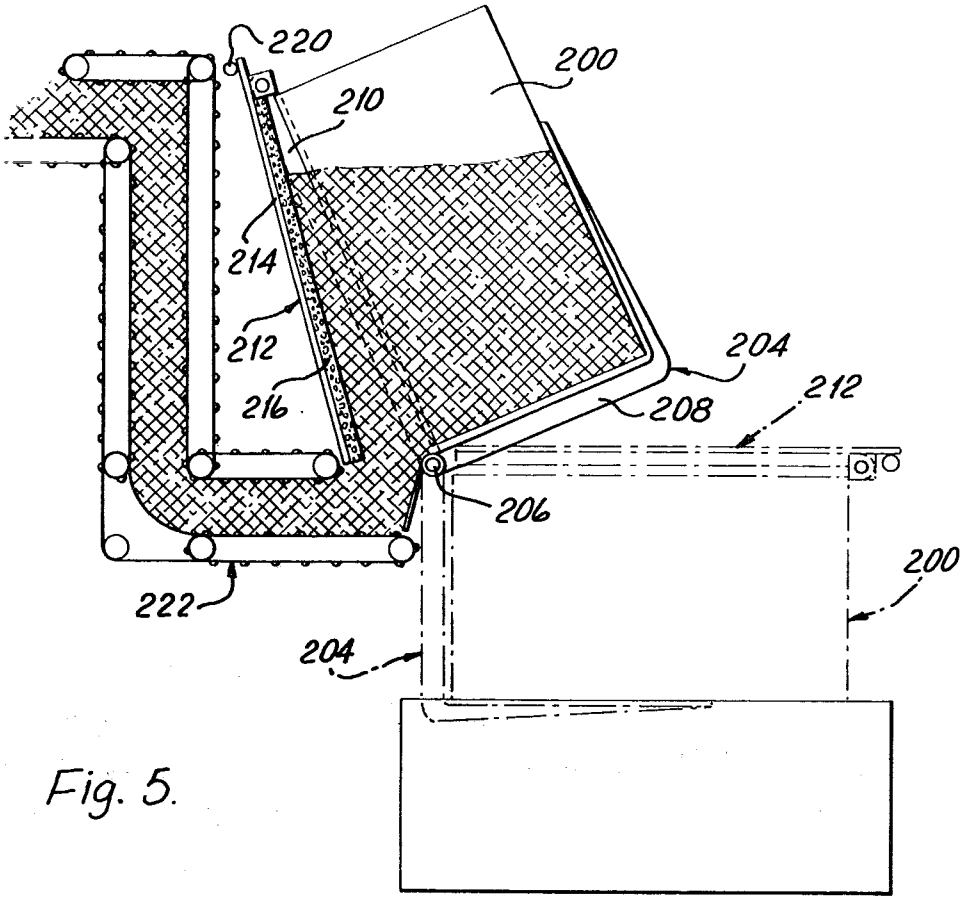
FIG. 5 is an elevation of another form of tray unloader.
Figure 6:
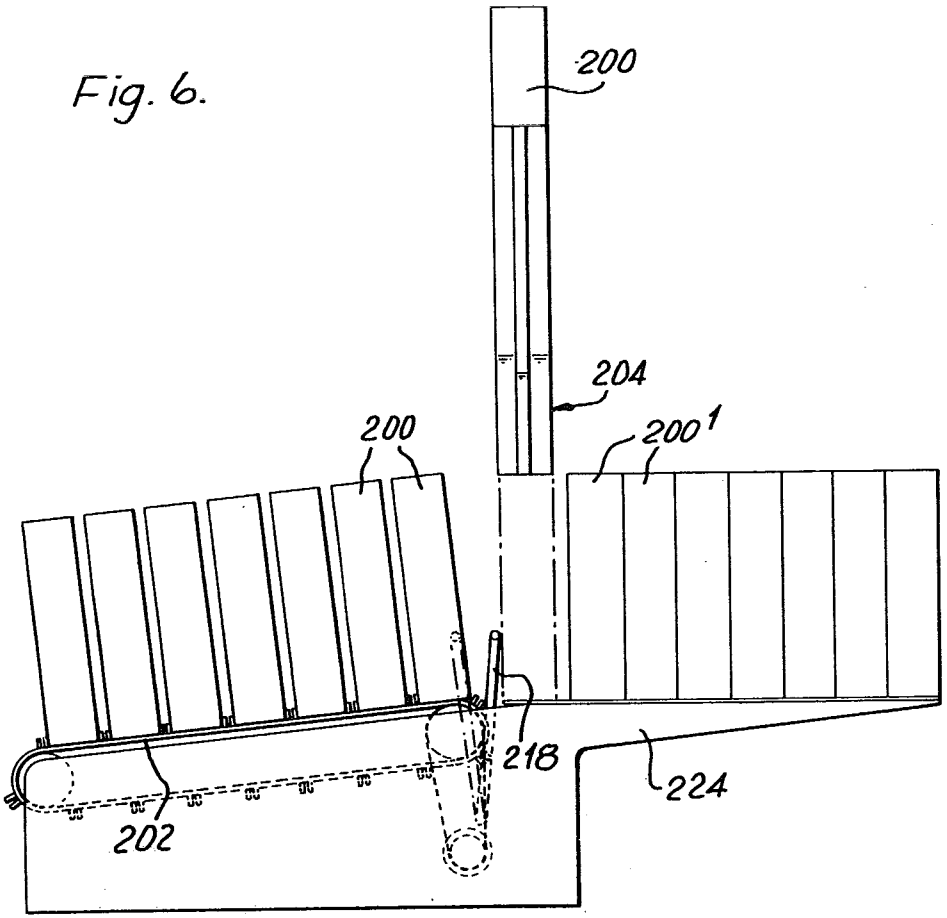
FIG. 6 is a side view of the tray unloader of FIG. 5.

In the tray unloader shown in FIGS. 5 and 6 full trays 200 are carried on an inclined conveyor 202 towards an unloading position at which successive trays are received by a tray support cradle 204 pivotally mounted about a fixed axis 206. The cradle 204 comprises an L-shaped bracket 208 extending from the axis 206 and providing support for a side edge and the bottom of a tray, and a pair of parallel cross members 210 connected to the bracket 208 near the axis 206 and extending in a direction parallel to the lower limb of the bracket. The cross members 210 are spaced apart by a distance slightly exceeding the lengths of the rod-like articles carried by a tray 200 and carry a pivoted closure member 212 at their ends remote from the axis 206. The member 212 comprises a plate 214 having a width such that it spans the distance between cross members 210 and a strip 216 of foamed rubber or polyurethane material of slightly lesser width.

With the cradle 204 and closure member 212 in the positions indicated in chain-dotted lines in FIG. 5, a full tray 200 is advanced from the end of the conveyor 202, into a position where it is supported on the cradle 204, by means of a pivoted pusher member 218 (FIG. 6). Subsequently the cradle 204, is rotated about axis 206 towards the position indicated in full lines in FIG. 5, the closure member 212 being maintained in position over the open upper end of the tray until it is released by pressure resulting from abutment of the plate 214 with a fixed stop 220. It would also be possible for the closure member 212 to be arranged so that it rests on top of the cross members 210 and simply swings away to allow the tray to unload as the cradle 204 reaches a sufficient inclination.

The tray 200, which is prevented from sliding out of the bracket 208 by abutments carried by the ends of the cross members 210, is able to unload its contents through the gap between its upper end and the open closure member 212, as shown in FIG. 5. The foam strip 216 serves to help prevent damage to the rod-like articles as they leave the tray. The articles are moved away from the unloading position by a stack conveyor system 222 which may be similar to that described with reference to FIGS. 1 to 4.

Although FIG. 5 shows the tray 200 inclined at a somewhat lesser angle, the flow of articles from the tray may be slightly more easily controlled if the tray is rotated such that the closure member 212 and the side of the tray adjacent bracket 208 subtend approximately the same angle to the horizontal, i.e. slightly more than 45°.

When the tray 200 has been unloaded, as determined by means of a photocell arrangement for example, the cradle 204 is returned to the position indicated in chain-dotted lines in FIG. 5 by rotation about the axis 206, and the pusher member 218 is used again, to advance the now empty tray on to a platform 224 (FIG. 6) from which it can be removed for reloading. As shown, the pusher 218 can be used each time to advance an accumulating row of abutting empty trays 200' or, alternatively, successive trays could be fed on to a conveyor for removal. After removing an empty tray from the cradle 204 the pusher 218 is returned to a position from which it can move another full tray from the conveyor 202 into the cradle. It will be appreciated that, in order to do this, the movement of the pusher 218 must be such that on its return stroke it does not foul either the cradle 204 or the next tray itself. A suitable movement could involve sideways retraction of the pusher during the return stroke, controlled for example by fixed cam surfaces. Alternative suitable tray advancing mechanisms could involve a square-motion drive conveyor or a retractable tray-moving abutment, such as disclosed in our British Patent Specification No. 1547809.

Both the apparatus of FIGS. 1 to 4 and that of FIGS. 5 and 6 can be operated automatically or semi-automatically. While full details of the drives for achieving the various required movements have been omitted, it will be readily apparent that rotational movement can be obtained by use of conventional motors and drive belts with electrical or electro-mechanical controls. Where linear movements are required (as, for example, in the tray supports of FIGS. 1 to 4) pistons can be used or, alternatively, the movable parts could be mounted on intermittently driven rotatable threaded rods so that rotation of the rod (by a conventional motor) causes the required linear movement.

It is important that the stack (or stacks) of cigarettes in a tray is restricted during inversion of the tray, in order to prevent relative movement of the cigarettes which could result in some cigarettes becoming misaligned. The safety plate 22 and the closure member 212 should therefore be capable of accommodating variations and differences in stack height, i.e. the depth of cigarettes in a tray 14 or 200, so that the upper cigarettes are restricted. For this purpose the safety plate or closure member preferably bears lightly on the upper cigarettes. The hinged mounting of the closure member 212 and its resilient strip 216 are helpful in this respect but could additionally be provided with an adjustable catch and/or some form of bias to load the member lightly into contact with the upper cigarettes in a tray. Similarly, the safety plate 22 may be provided with vertical adjustment and/or bias relative to the elements 20 so that any gap between the cigarettes in a tray and the plate is minimized.

A further factor to be considered in relation to maintaining cigarette alignment in trays where the stack is not fully restricted, i.e. where the stack is slightly "loose" in the tray, is the speed of rotation during inversion: preferably this should be as high as practicably possible.

We claim:

1. Apparatus for unloading trays of rod-like articles, comprising a tray carrier for receiving a tray which is capable of holding at least one stack of rod-like articles arranged with their lengths parallel; the tray carrier being rotatable, about an axis parallel to the lengths of the rod-like articles in a tray supported by the carrier, between a first position at which the tray carrier can receive a tray in a substantially upright position and a second position at which a tray held by the carrier is at least partially inverted; and delivery means for moving away rod-like articles unloaded from a tray when the carrier is in the second position, the delivery means including means rotatable with the carrier from said first position towards said second position and subsequently revolvable relative to said carrier to direct articles from said tray towards an opening which is at least partly defined by said means rotatable with the carrier and which is at least approximately centrally disposed relative to the stack of articles unloading from said tray, wherein the means rotatable with the carrier and subsequently rotatable relative to the carrier includes an endless conveyor band.

2. Apparatus as claimed in claim 1, wherein the delivery means includes at least one endless band conveyor for moving rod-like articles away from an unloading tray in the form of a stack.

3. Apparatus as claimed in claim 2, wherein the delivery means includes a stack elevator.

4. Apparatus as claimed in claim 1, wherein the tray carrier is arranged to be rotated through about 180° between said first and second positions.

5. Apparatus as claimed in claim 4, including a pair of tray carriers mounted in 180° rotational symmetry relative to said axis.

6. Apparatus as claimed in claim 1 including conveyor means for delivering full trays to the tray carrier and for removing empty trays from the tray carrier, the conveyor means extending generally in a direction parallel to said axis.

7. Apparatus as claimed in claim 6, said conveyor means including a tray delivery conveyor and a tray removal conveyor located at different levels, and a tray elevator for moving trays between said levels.

8. Apparatus as claimed in claim 6, including a path for full trays and a path for empty trays conveyed by said conveyor means, said paths being substantially in alignment.

9. Apparatus for unloading trays of rod-like articles comprising a tray carrier for receiving a tray which is capable of holding at least one stack of rod-like articles arranged with their lengths parallel, the tray carrier being rotatable, about an axis parallel to the lengths of the rod-like articles in a tray supported by the carrier, between a first position at which the tray carrier can receive a tray in a substantially upright position and a second position at which a tray held by the carrier is at least partially inverted; delivery means for moving away rod-like articles unloaded from a tray when the carrier is in the second position, the delivery means including means rotatable with the carrier for directing articles from said tray towards an opening which is at least partly defined by said means rotatable with the carrier and which is at least approximately centrally disposed relative to the stack of articles unloading from said tray, and removable closure means for retaining rod-like articles in the tray as the carrier is rotated until said second position is reached.

10. Apparatus for unloading trays of rod-like articles comprising a tray carrier for receiving a tray which is capable of holding at least one stack of rod-like articles arranged with their lengths parallel, the tray carrier being rotatable, about an axis parallel to the lengths of the rod-like articles in a tray supported by the carrier, between a first position at which the tray carrier can receive a tray in a substantially upright position and a second position at which a tray held by the carrier is at least partially inverted; and delivery means for moving away rod-like articles unloaded from a tray when the carrier is in the second position, the delivery means including a pair of band conveyors positioned beneath a tray in said second position, said conveyors being arranged to be driven towards each other to deliver the unloading rod-like articles between confronting ends of the conveyors and a stack delivery conveyor for conveying away articles delivered downwards between said pair of band conveyors.

11. Apparatus as claimed in claim 10, wherein at least one of said pair of band conveyors is mounted for rotation with said carrier about said axis.

12. Apparatus for unloading trays of rod-like articles comprising a pair of tray carriers for receiving respective trays which are capable of holding at least one stack of rod-like articles arranged with their lengths parallel, each of the tray carriers being rotatable, about an axis parallel to the lengths of the rod-like articles in a tray supported by the carrier through about 180° between a first position at which the tray carrier can receive a tray in a substantially upright position and a second position at which a tray held by the carrier is at least partially inverted, and said carriers being mounted in 180° rotational symmetry relative to said axis; and delivery means for moving away rod-like articles unloaded from a tray when the carrier is in the second position, the delivery means including means rotatable with the carrier for directing articles from said tray towards an opening which is at least partly defined by said means rotatable with the carrier and which is at least approximately centrally disposed relative to the stack of articles unloading from said tray, each tray carrier being movable in a direction parallel to said axis so that said carriers may be rotated in different axially-spaced parallel planes during movement from said first to said second and from said second to said first positions respectively.

13. Apparatus for unloading trays of rod-like articles comprising a tray carrier for receiving a tray which is capable of holding at least one stack of rod-like articles arranged with their lengths parallel, the tray carrier being rotatable, about an axis parallel to the lengths of the rod-like articles in a tray supported by the carrier, between a first position at which the tray carrier can receive a tray in a substantially upright position and a second position at which a tray held by the carrier is at least partially inverted; and delivery means for moving away rod-like articles unloaded from a tray when the carrier is in the second position, the delivery means including means rotatable with the carrier for directing articles from said tray towards an opening which is at least partly defined by said means rotatable with the carrier and which is at least approximately centrally disposed relative to the stack of articles unloading from said tray and a pair of band conveyors positioned beneath a tray in said second position and having confronting ends defining said opening, said means rotatable with the carrier including at least one of said band conveyors which is mounted for rotation about said axis.

* * * * *